US006007188A

United States Patent [19]

MacLeod et al.

[11] Patent Number: 6,007,188

[45] Date of Patent: Dec. 28, 1999

[54] PARTICLE TOLERANT PRINTHEAD

[75] Inventors: Cheryl A. MacLeod; John B. Smyth; David Pidwerbecki; Joe E. Stout, all of Corvallis, Oreg.

[73] Assignee: Hewlett-Packard Company, Palo Alto, Calif.

[21] Appl. No.: 08/904,060

[22] Filed: Jul. 31, 1997

[51] Int. Cl.[6] ..... B41J 2/05; B41J 2/175

[52] U.S. Cl. ..... 347/65; 347/93

[58] Field of Search ..... 347/65, 67, 93, 347/95; 216/2, 27; 29/890.1

[56] References Cited

U.S. PATENT DOCUMENTS

| | | | |
|---|---|---|---|
| 4,394,670 | 7/1983 | Sugitani et al. | 346/140 |
| 4,502,060 | 2/1985 | Rankin et al. | 346/140 |
| 4,771,295 | 9/1988 | Baker et al. | 346/1.1 |
| 4,875,059 | 10/1989 | Masuda | 346/140 |
| 4,963,882 | 10/1990 | Hickman | 346/1.1 |
| 5,025,271 | 6/1991 | Baker et al. | 346/140 |
| 5,189,787 | 3/1993 | Reed et al. | 29/831 |
| 5,194,877 | 3/1993 | Lam et al. | 346/1.1 |
| 5,278,584 | 1/1994 | Keefe et al. | 346/140 |
| 5,291,226 | 3/1994 | Schantz et al. | 346/140 |
| 5,450,109 | 9/1995 | Hock | 347/67 |
| 5,463,413 | 10/1995 | Ho et al. | 347/65 |
| 5,519,424 | 5/1996 | Scardovi et al. | 347/65 |
| 5,640,183 | 6/1997 | Hackleman | 347/40 |
| 5,734,399 | 3/1998 | Weber et al. | 347/65 |
| 5,808,644 | 9/1998 | Imamura et al. | 347/93 |

FOREIGN PATENT DOCUMENTS

| | | |
|---|---|---|
| 0314486A2 | 6/1989 | European Pat. Off. . |
| 0500068A2 | 8/1992 | European Pat. Off. . |
| 7-164639 | 6/1995 | Japan . |

*Primary Examiner*—Joan Pendegrass
*Attorney, Agent, or Firm*—Raymond A. Jenski

[57] ABSTRACT

Islands of barrier layer material of an inkjet printhead are disposed between an ink source and the ink feed channels leading to the ink firing chambers to filter particles in the ink. Dimensions of the ink feed channels and ink ejecting orifices have been reduced in size and the thickness of the barrier layer has been made thinner. The nominal size of the filter pores is less than the barrier layer thickness while the width of the ink feed channels and the bore diameter of the orifices is larger than the barrier layer thickness.

17 Claims, 4 Drawing Sheets

PARTICLE TOLERANT PRINTHEAD

BACKGROUND OF THE INVENTION

The present invention is generally related to a printhead for an inkjet printer and more particularly related to a printhead employing a particle tolerant ink feed filter of small dimensions to reduce particle blockages while maintaining a high rate of ink filling.

Inkjet printers operate by expelling a small volume of ink through a plurality of small orifices in a surface held in proximity to a medium upon which marks or printing is to be placed. These orifices are arranged in a fashion in the surface such that the expulsion of a drop of ink from a selected number of orifices relative to a particular position of the medium results in the production of a portion of a desired character or image. Controlled repositioning of the orifice-bearing surface or the medium followed by another expulsion of ink drops results in the creation of more segments of the desired character or image. Furthermore, inks of various colors may be coupled to individual arrangements of orifices so that selected firing of the orifices can produce a multi-colored image by the inkjet printer.

Several mechanisms have been employed to create the force necessary to expel an ink drop from a printhead, among which are thermal, piezoelectric, and electrostatic mechanisms. While the following explanation is made with reference to the thermal ink expulsion mechanism, the present invention has application for the other ink expulsion mechanisms as well.

Expulsion of the ink drop in a conventional thermal inkjet printer is a result of rapid thermal heating of the ink to a temperature which exceeds the boiling point of the ink solvent to create a vapor phase bubble of ink. Rapid heating of the ink is generally achieved by passing a pulse of electric current through an ink ejector which is an individually addressable heater resistor, typically for 1 to 3 microseconds, and the heat generated thereby is coupled to a small volume of ink held in an enclosed area which is generally referred to as a firing chamber. One of the enclosing walls of the firing chamber is formed by the surface which is penetrated by the plurality of orifices. One of the orifices in this orifice plate is arranged in relation to the heater resistor in a manner which enables ink to be expelled from the orifice. As the ink vapor bubble nucleates at the heater resistor and expands, it displaces a volume of ink which forces an equivalent volume of ink out of the orifice for deposition on the medium. The bubble then collapses and the displaced volume of ink is replenished from a larger ink reservoir by way of an ink feed channel in one of the walls of the firing chamber.

It is desirable to have the ink refill the chamber as quickly as possible, thereby enabling very rapid firing of the orifices of the printhead. Rapid firing of the orifices results in the ability to achieve high-speed printing in an inkjet printer. Before the next firing of the heater resistor, the ink must have sufficient time to refill the chamber so that an undesirable variation in the size of the ink drop will not occur. Thus, one limitation on the speed at which printing may occur is related to the speed at which the firing chamber is refilled.

A problem that occasionally manifests itself in inkjet printheads is that of blockage occurring in an ink feed channel or in the orifice of the printhead. Microscopic particles can become lodged in the channel leading to the ink firing chamber thereby causing premature failure of the heater resistor, misdirection of ink drops, or diminished ink supply to the firing chamber resulting in greatly diminished ink drop size. A single orifice which does not fire an ink drop when it is commanded to do so leaves a missing portion from a printed character or creates a band of missing drops from a printed image. The end result is perceived as a poorer quality of printed matter, a highly undesirable characteristic for an inkjet printer. To resolve this undesirable result, others have suggested using spare or redundant orifices to eject ink in place of defective ink ejectors (see, for example, U.S. Pat. Nos. 4,963,882 and 5,640,183) or multiple inlets to the ink firing chamber.

Ink for inkjet printing is conventionally stored in a reservoir associated with the printhead mechanism. The apparatus for storing ink, such as a porous foam material or a sealed container, is known to shed particles, which can plug ink feed channels or ejection orifices. It has been observed that many of the particles are elongate, fibrous particles which are undesired products of the manufacturing process. The fibrous particles occasionally disengage from the ink containment apparatus and are carried by the ink to the printhead despite special cleaning processes and ink filtering which occurs prior to the ink entering the printhead (such as that described in U.S. Pat. Nos. 4,771,295 and 5,025,271). The filtering of elongate particles has been addressed in U.S. patent application Ser. No. 08/500,796, "Particle Tolerant Inkjet Printhead Architecture", filed on behalf of Timothy Weber et al. on Jul. 11, 1995, in which a plurality of outer barrier islands prevent elongate particles from reaching the ink feed channels or the ink firing chamber. Ink filtering has also been disclosed in U.S. Pat. No. 5,463,413 in which a plurality of pillars is arranged between the ink reservoir and the firing chamber, each pillar associated with the entrance to a firing chamber. The pillars are spaced apart by a distance less than or equal to the smallest dimension of the system, and are placed as close as possible to a common ink source to prevent particles from entering the firing chamber. The smallest dimension of the system is likely to be either the orifice bore diameter or the width of the passageway connecting the source of ink to the firing chamber.

As the dimensions of the orifices, firing chambers, and ink feed channels are reduced in order to provide improved printing characteristics, the size of the particles which, because of their small size, have passed through the ink feed channels and have been expelled from the orifices of previous designs, can now clog the printhead. In a design which employs orifices or ink feed channels having dimensions smaller than 20 $\mu$m, particles and contaminants such as skin cells become candidates for lodging in the ink feed channel or orifice. Furthermore, particles such as skin and other biological cells are not rigid and therefore can deform and pass through a filter having a pore size equal to the smallest dimension in the printhead. Previous attempts to control and filter particles, while well suited for larger particles, do not solve the problem of clogging of the smaller passageways by the smaller particles.

SUMMARY OF THE INVENTION

A printhead which ejects ink from at least one firing chamber for an inkjet printer includes a substrate with an ink ejector disposed thereon. A barrier layer is disposed on at least a portion of the substrate, has a thickness of a first dimension, has at least one ink feed channel which couples ink from a source of ink to the firing chamber. The ink feed channel has walls that are formed by an elongated separation of the barrier layer, the substrate and an orifice plate. The elongated separation is defined by a width of a second dimension. The barrier layer includes a plurality of islands, each spaced apart from an adjacent island by no more than a third dimension and disposed between the source of ink and the at least one ink feed channel. The second dimension is equal to or greater than the first dimension and the third dimension is less than the first dimension.

DETAILED DESCRIPTION OF THE PREFERRED EMBODIMENTS

Figure 1:
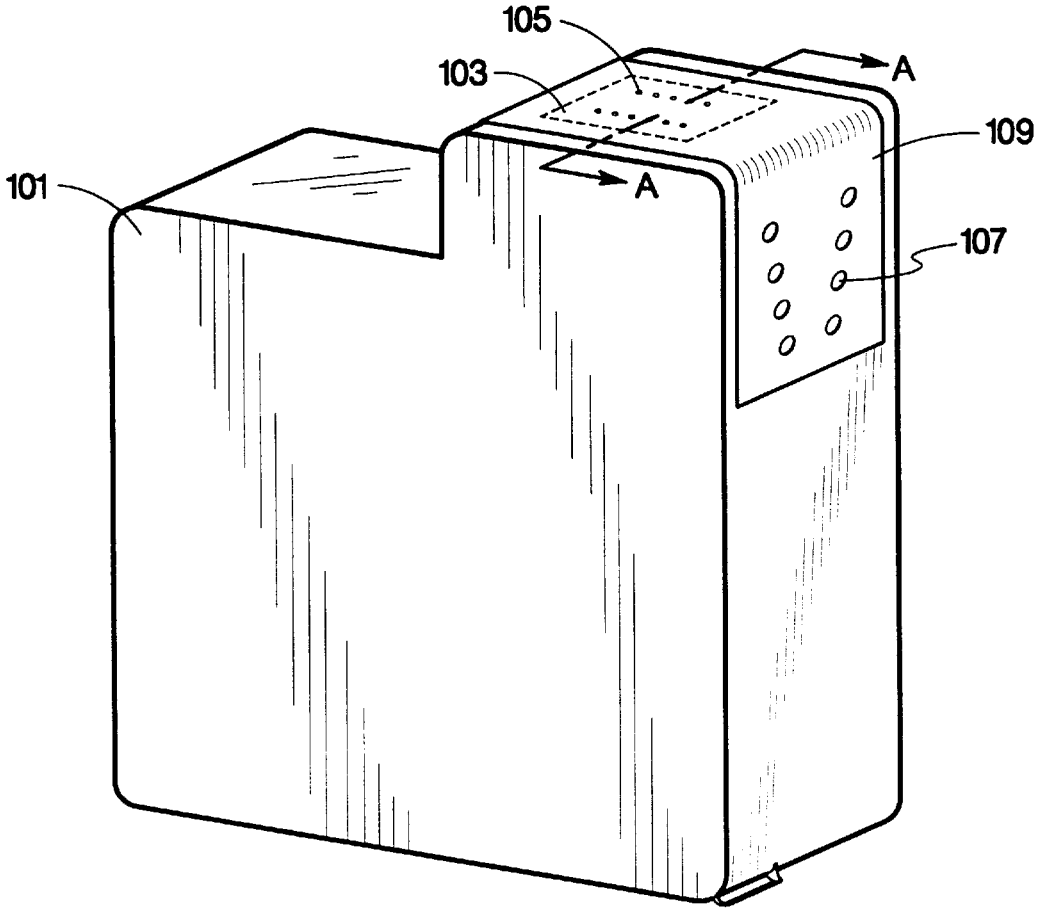
FIG. 1 is an isometric view of an inkjet printer print cartridge.

A typical inkjet cartridge is shown in FIG. 1, in which a cartridge body member 101 houses a supply of ink and routes the ink to a printhead 103 via ink conduits. Visible at the outer surface of the printhead are a plurality of orifices 105 through which ink is selectively expelled upon commands of the printer (not shown), which commands are communicated to the printhead 103 through electrical connections 107 and associated conductive traces (not shown). In one implementation of an inkjet print cartridge, the printhead is constructed from a semiconductor substrate, including thin film heater resistors disposed on or in the substrate, a photo definable barrier and adhesive layer, and a foraminous orifice plate which has a plurality of orifices extending entirely through the orifice plate as exemplified by orifice 105. Physical and electrical connections are made to a flexible polymer tape 109 by way of beam lead bonding or similar semiconductor technology which is subsequently secured by an epoxy-like material for physical strength and fluid rejection. The polymer tape 109 may be formed of Kapton™, commercially available from 3M Corporation, or similar material which may be photoablated or chemically etched to produce openings and other desirable characteristics. Copper or other conductive traces are deposited or otherwise secured on one side of the tape so that electrical interconnections 107 can be contacted with the printer and routed to the substrate. The tape is typically bent around an edge of the print cartridge as shown and secured.

Figure 2:
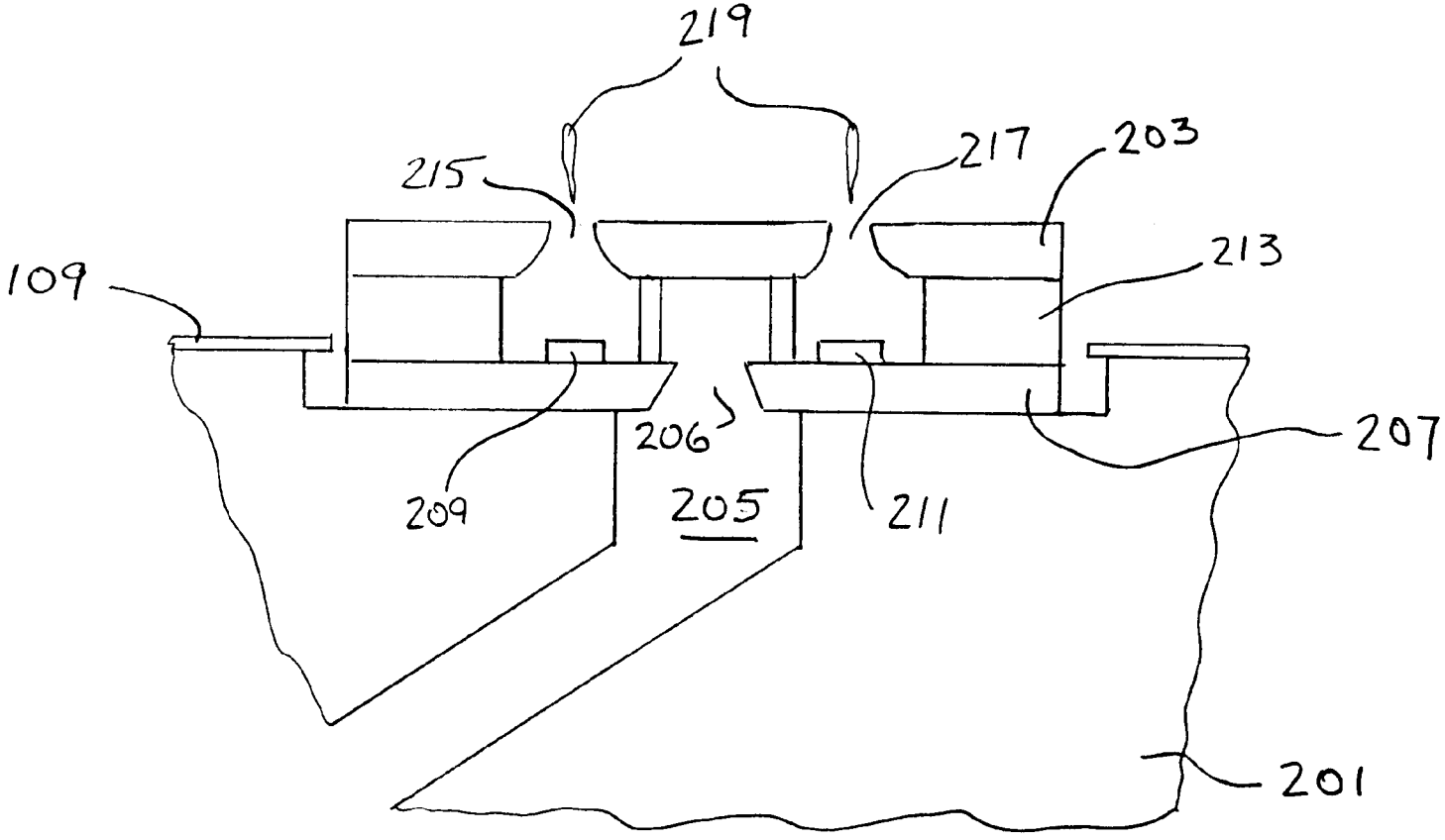
FIG. 2 is a cross sectional elevation view of the printhead which may be employed in the inkjet print cartridge of FIG. 1.

A cross section of the printhead is shown in FIG. 2 and is taken from part of the section A—A shown in FIG. 1. A portion of the body 201 of the cartridge 101 is shown where it is secured to the printhead by an adhesive in association with pressure. In the preferred embodiment, ink is supplied to the printhead by way of a common ink plenum 205 and through a slot 206 in the printhead substrate 207. (Alternatively, the ink may be supplied along the sides of the substrate). Heater resistors and their associated orifices are conventionally arranged in two essentially parallel rows near the inlet of ink from the ink plenum. In many instances the heater resistors and orifices are arranged in a staggered configuration in each row and, in the preferred embodiment, the heater resistors are located on opposite sides of the slot 206 of the substrate 207, as exemplified by heater resistors 209 and 211 in FIG. 2.

The orifice plate 203 is produced by electrodepositing nickel on a mandrel having pegs and dikes with appropriate dimensions and suitable draft angles in the form of a couplement of the features desired in the orifice plate so that upon completion of a predetermined amount of time a thickness of nickel has been deposited. The resultant nickel film is removed after cooling and then mechanically planarized and treated for subsequent use. The nickel orifice plate is then coated with a precious metal such as gold, paladium, or rhodium to resist corrosion. Following its fabrication, the orifice plate is affixed to the semiconductor substrate 207 with a barrier layer 213. The orifices created by the electrodeposition on the mandrel extend from the outside surface of the orifice plate 203 through the material to the inside surface, the surface which forms one of the walls of the ink firing chamber. Usually, an orifice is aligned directly over the heater resistor so that ink may be expelled from the orifice without a trajectory error introduced by an offset.

The substrate 207 and orifice plate 203 are affixed together by a barrier layer material 213. In the preferred embodiment, the barrier layer material 213 is disposed on the substrate 207 in a patterned formation such that firing chambers 215 and 217 are created in areas around the heater resistors. The barrier layer material is also patterned so that ink is supplied independently to the firing chambers by one or more ink feed channels. Ink drops 219 are selectively ejected upon the rapid heating of a heater resistor upon command by the printer. The substrate having the barrier layer affixed to one surface is then positioned with respect to the orifice plate such that the orifices are precisely aligned with the heater resistors of the substrate.

The barrier layer 213, in the preferred embodiment, utilizes a polymeric photodefinable material such as Parad™, Vacrel™, IJ5000, or other materials which are a film negative photosensitive, multi-component, polymeric dry film which polymerizes with exposure to light or similar electromagnetic radiation. Materials of this sort are available from DuPont of Wilmington, Del. The barrier layer is first applied as a continuous layer upon the substrate 207 with the application of sufficient pressure and heat suitable for the particular material selected. Generally, the barrier layer film is sandwiched between protective sheets of mylar. One sheet is removed to enable lamination of the barrier layer to the substrate. The other mylar sheet is left in place until the barrier layer is exposed. The photolithographic layer is exposed through a negative mask to ultraviolet light (preferably in the range of wavelengths of 440–340 nm) to polymerize the barrier layer material. The exposed barrier layer is then subjected to a chemical wash using a developer solvent of a 74:26 w/w % mixture of N-methyl-2-pyrrolidone and diethylene glycol so that the unexposed areas of the barrier layer are removed by chemical action. The remaining areas of barrier layer form the walls of each ink firing chamber around each heater resistor. Also, the remaining areas of barrier layer form the walls of ink feed channels which lead from the ink firing chamber to a source of ink (such as the ink plenum 205 by way of the slot as shown in FIG. 2). These ink feed channels enable the initial fill of the ink firing chamber with ink and provide a continuous refill of the firing chamber after each expulsion of ink from the chamber. The rate at which ink can enter and fill the ink firing chamber is a significant factor in determining the highest speed at which the printer can print. In the preferred embodiment, two ink feed channels are created in the barrier layer to couple the ink plenum to the ink firing chamber so that a redundant supply of ink is maintained to the chamber and that a high rate of refill can be realized without having a significant part of the energy created for the ink bubble vaporization being lost from the ink feed channels.

A lamination of orifice plate to the barrier layer is accomplished with the application of heat (approximately 200°) and pressure (between 50 and 250 psi.) for a period of time up to 15 minutes in the preferred embodiment. Adhesion promoters, such as those disclosed in the U.S. patent application Ser. No. 08/742,118, filed on behalf of Garold Radke et al. On Oct. 1, 1996, may be employed to enhance the bond between the orifice plate and barrier layer. A final set-up of the polymer and cure of the bond is then accomplished with a thermal soak at approximately 220° for approximately 30 minutes.

Figure 3:
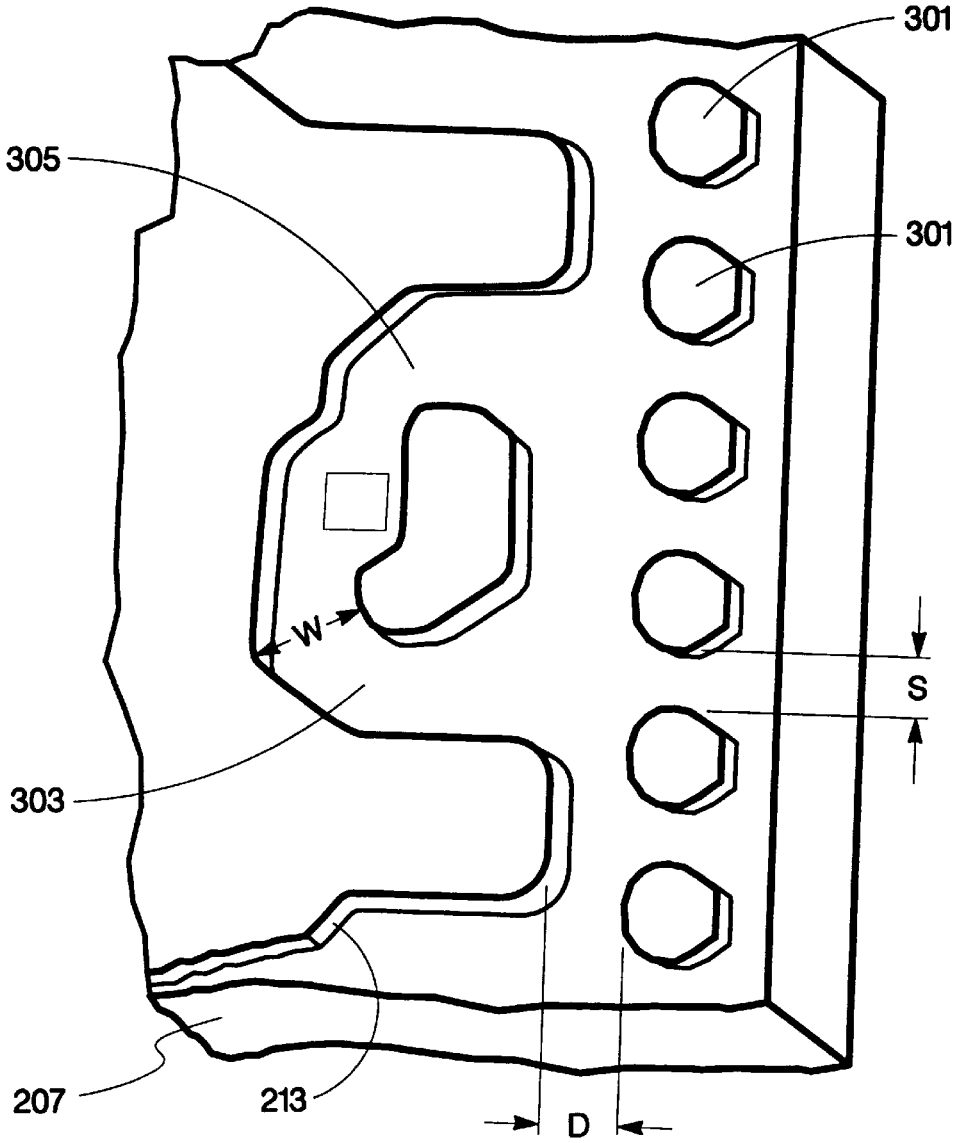
FIG. 3 is an isometric plan view of the barrier layer and substrate of a printhead which may employ the present invention.

One additional feature is created in the barrier layer of the preferred embodiment. At the entrance to each ink feed channel there is disposed a plurality of barrier layer islands 301 such as shown in the isometric plan view of the surface of the substrate (with the orifice plate removed) of FIG. 3. Each barrier island is composed of barrier material and extends the full thickness of the barrier layer 213 from the substrate 207 to the orifice plate. In order to avoid delamination of the islands from either the orifice plate or the substrate, each barrier island offers an area of adhesion of approximately 200 $\mu m^2$ to each surface. The major purpose of these barrier islands is to prevent particles and contaminants from the ink from reaching the ink feed channels and the orifice of each firing chamber. In order to function properly, this filter requires that the spaces (S) between each island (the equivalent of filter pores) be smaller than the channel width (W) of each firing chamber and smaller than the diameter of the orifice bore. Thus, any contaminant which could lodge in the ink feed channel or in the orifice is blocked from these critical areas. As a result of a number of islands (and spaces between), the blockage of any one of the spaces between the islands does not seriously impede the flow of ink to each ink feed channel and the likelihood of occlusion of an ink firing chamber is considerably reduced filter. Experiments with various spacing dimensions (S=10, 12, and 14 $\mu$m) has demonstrated that at high rates of ink firing chamber refill, the performance of the printhead is unaffected by this range of dimensions.

In the preferred embodiment, the dimensions of many of the elements of the printhead have been made significantly smaller than previously known designs to produce a high quality of ink printing by using small ink drops. The nominal ink drop weight is approximately 10 ng for ejection from an orifice having a bore diameter of 18 $\mu$m (±2 $\mu$m). In order to achieve an ink firing chamber refill rate supportive of a 15 KHz frequency of operation, two offset ink feed channels 303, 305 are employed to provide redundant ink refill capability. Each ink feed channel has a channel width W of 17 $\mu$m (±2 $\mu$m) and a channel length of approximately 30 $\mu$m. Channels and orifices of these dimensions present a greater challenge to the filtering of contaminants than previously undertaken in that particles the size of human skin cells will block an ink feed channel or orifice. Since particles of this size include some beiological cells which are non-rigid, the filter pore size must be less than the smallest operational dimension of the printhead to trap the potentially blocking particle. Depending upon the particular application, the smallest operational dimension is either the ink feed channel, W, of 17 $\mu$m (±2 $\mu$m) or the orifice bore diameter of approximately 18 $\mu$m. In the preferred embodiment, the spacing (S) between each island is 12 $\mu$m (±0.5 $\mu$m). The thickness of the barrier layer is 14 $\mu$m (±1.5 $\mu$m).

Figure 4A:
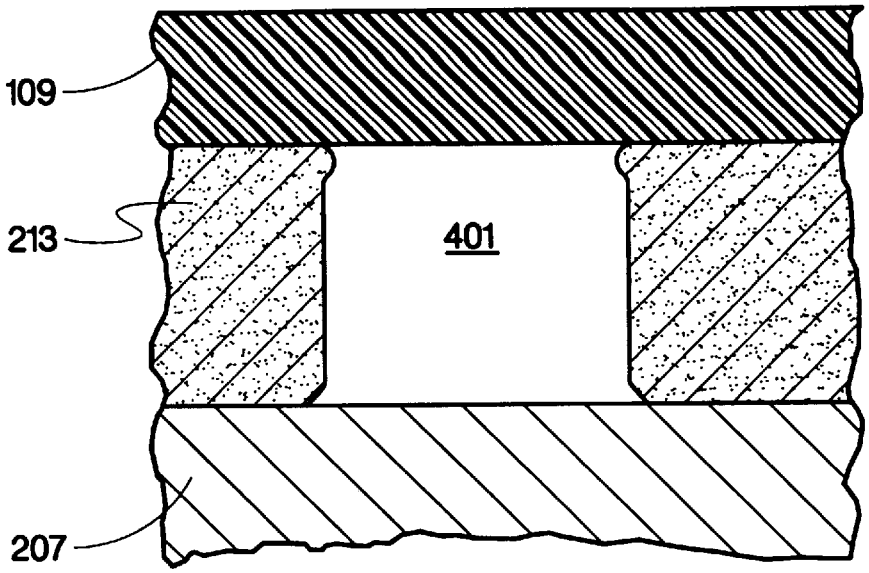
FIGS. 4A and 4B are cross sectional elevation views of an ink feed channel which illustrate the effect of barrier layer bridging.
Figure 4B:
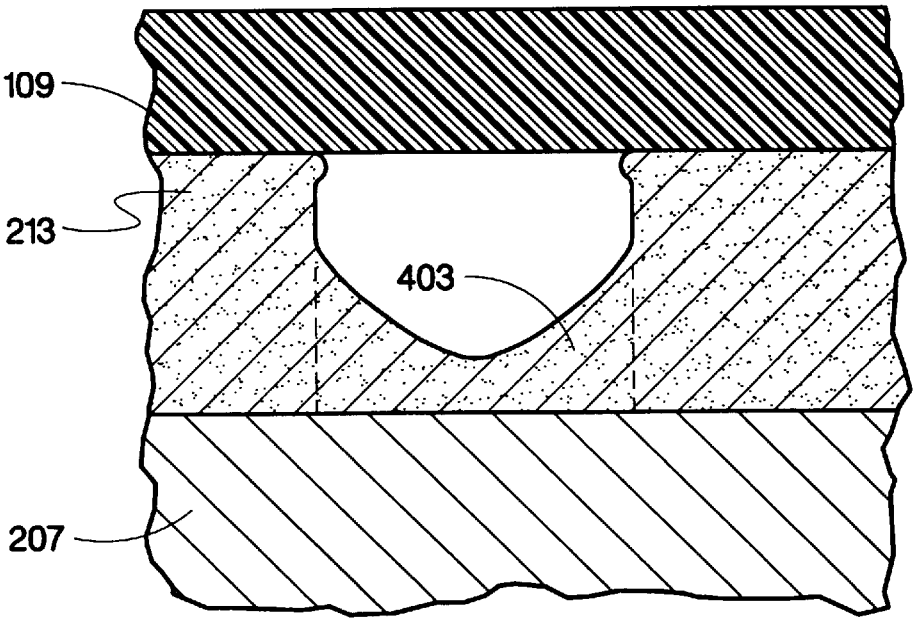

Negative photoresists are well-known for resolution limitations primarily due to swelling during the material photo development process. It is known that any feature defined in the barrier layer, or the space between any such feature, should have dimensions which exceed the thickness dimension of the barrier layer. See, Weiss, "Photoresist Technology Update", Semiconductor International, April 1983, which states that negative photoresist materials are limited to layer thickness to feature dimensions of 1:2 or 1:3 ratios while positive resists were capable of 1:1 ratios. An example of a desired ink feed channel cross section is shown in FIG. 4A. The substrate 207 has the barrier layer 213 disposed on its surface. Orifice plate 203 is secured to the barrier layer 213. The barrier layer has had a channel 401 photodefined and developed into the barrier layer so that an ink feed channel has been created by the sandwich of substrate, barrier layer, and orifice plate. When the width dimension of the channel is less than the thickness dimension of the barrier layer, incomplete development occurs and a bridge 403 of barrier layer remains across the narrow channel as shown in FIG. 4B. This bridge occludes the channel and reduces the volume of ink flow to the ink firing chamber.

It has been determined that the depletion of dissolved oxygen during exposure limits the channel width that can be defined between large features. For a given barrier thickness, exposure dose, dose rate, temperature, and oxygen availability at the barrier surface, oxygen diffusion is believed to be limited to a finite distance. When barrier thickness is such that a channel is defined within this distance, the oxygen diffusion proximity effect becomes more important than swelling in limiting aspect ratio.

When an area of barrier layer material is exposed to ratiation, chemical reactions are induced in the barrier film that form free radicals. Theres free radicals combine to form crosslinking reactions that make exposed areas immune to the developer solvent and thus define the desired image; however, in a usual manufacturing environment, diatomic oxygen from the air is in equilibrium with the other components in the barrier layer film. Before the crosslinking reactions may ensue, the oxygen molecules—which are much more reactive to free radicals—must first be depleted. Once the amount of radiation required to react with the immedicately-available oxygen is exceeded, further radiation cross-links the material.

The proximity effect that caused "incomplete development" (or "bridging") occurs at the interface between the exposed and unexposed areas of barrier: the exposed side has been depleted of oxygen molecules; the unexposed side still has the equilibrium concentration. Thus, because the barrier layer film is separated from the oxygen in the air by its mylar cover film, an instanteous concentration gradient forces migration of oxygen molecules into the exposed area from the adjacent unexposed barrier in order to equalize the distribution of oxygen. Oxygen migration out of the unexposed channel then lowers the amount of radiation required to expose the barrier because there are fewer oxygen molecules to quench before the onset of crosslinking, thus allowing the masked channel to be undesirably exposed by radiation scattered from the unmasked area. Thus, in an inkjet printhead, when the barrier layer thickness is greater than the width of the feature being developed and the feature is in close proximity to a large volume of barrier material, bridging of the feature is expected to occur. However, when the feature has a width dimension less than the barrier layer thickness but is at a distance from large volumes of barrier material, bridging does not occur for widths less than the barrier thickness but greater than 0.6 the barrier layer thickness at the exposure energy used for defining the rest of the pattern. The distance the feature must be separated from the large volume of exposed material by a factor of 2 to 5 the barrier layer thickness depending upon the acutal size of the large volume of exposed material. Accordingly, in the preferred embodiment of the present invention, the islands 301 are spaced apart from the nearest volume of barrier layer by a distance (D) of 10 $\mu$m (±0.25 $\mu$m). It should be noted that the dimensions for the barrier layer features are given as the dimensions of the photo-resist mask. The spacings between barrier layer walls, spacings such as 5, the barrier island spacing, and w, the ink feed channel width, are expected to become between 1 and 2 $\mu$m larger than the photoresist mask dimensions.

Thus, the placement of islands of barrier layer between the ink supply and the ink feed channels to the firing chamber and separated by a distance smaller than the width of the ink feed channel or the diameter of the orifice bore will diminish the blocking of the ink feed channel or the orifice bore by contaminants in the ink. When the dimensions of the spaces between the islands is less than the thickness of the barrier layer, bridging between the islands is precluded by spacing the islands away from the rest of the barrier layer material.

We claim:

1. A printhead which ejects ink from at least one firing chamber for an inkjet printer comprising:

a substrate having an ink ejector disposed thereon;

a barrier layer disposed on at least a portion of said substrate, said barrier layer including:

a layer thickness of a first dimension, at least one ink feed channel by which ink is coupled from a source of ink to the firing chanber, said at least one ink feed channel having walls formed by an elongated separation of said barrier layer, said substrate, and an orifice plate, said elongated separation defined by a width of a second dimension, and a plurality of islands, each island of said plurality of islands spaced apart from an adjacent island by no more than a third dimension and disposed between said source of ink and said at least one ink feed channel; and wherein said second dimension is equal to or greater than said first dimension and said third dimension is less than said first dimension.

2. A printhead in accordance with claim 1 wherein each island of said plurality of islands is disposed no closer to either elongated separation wall than 9.75 $\mu$m.

3. A printhead in accordance with claim 1 wherein said orifice plate is disposed on said barrier layer and has an orifice therethrough, extending from a surface of said orifice plate nearest barrier layer to an external surface of said orifice plate and positioned relative to said ink ejector whereby ink may be expelled by said ink ejector.

4. A printhead in accordance with claim 3 wherein said orifice plate further comprises said orifice having a minimum bore dimension greater than said first dimension.

5. A printhead in accordance with claim 1 further comprising a first dimension of 14 $\mu$m, a second dimension of 17 $\mu$m, and a third dimension of 12 $\mu$m.

6. A printhead in accordance with claim 4 further comprising a minimum bore dimension of 18 $\mu$m.

7. A printhead which ejects ink from at least one firing chamber for an inkjet printer, comprising:

a substrate having an ink ejector disposed thereon;

a barrier layer disposed on at least a portion of said substrate, said barrier layer including:

a layer thickness of a first dimension, at least one ink feed channel by which ink is coupled from a source of ink to the firing chamber, said at least one ink feed channel having walls formed by an elongated separation of said barrier layer, said substrate, and an orifice, and a plurality of islands, each island of said plurality of islands spaced apart from an adjacent island by no more than a second dimension and disposed between said source of ink and said at least one ink feed channel;

said orifice plate disposed on said barrier layer and having an orifice therethrough, extending from a surface of said orifice plate nearest said barrier layer to an external surface of said orifice plate, positioned relative to said ink ejector whereby ink may be expelled by said ink ejector, and including a bore of a third dimension; and wherein said second dimension is less than said first dimension and said first dimension is less than said third dimension.

8. A printhead in accordance with claim 7 wherein said elongated separation of said barrier layer includes a width of a fourth dimension, said foruth dimension equal to or greater than said first dimension.

9. A printhead in accordance with claim 8 further comprising a first dimension of 14 $\mu$m, a second dimension of 12 $\mu$m, a third dimension of 18 $\mu$m, and a fourth dimension of 17 $\mu$m.

10. A printhead in accordance with claim 7 wherein each island of said plurality of islands is disposed no closer to either elongated separation wall than 9.75 $\mu$m.

11. A method of manufacture of a printhead which ejects ink from at least one firing chamber for an inkjet printer, comprising the steps of:

disposing a barrier layer having a thickness of a first dimension on a portion of a substrate;

exposing a predetermined portion of said barrier layer to electromagnetic radiation, said predetermined portion including walls of an ink feed channel which couples ink from a source of ink to the firing chamber and spaced apart from each other by a second dimension, and a plurality of islands, each island of said plurality of islands spaced apart from an adjacent island of said plurality of islands by no more than a third dimension and disposed between said source of ink and said ink feed channel, said second dimension being equal to or greater than said first dimension and said third dimension being less than said first dimension; and developing said barrier layer to remove portions of said barrier layer not exposed to electromagnetic radiation.

12. A method in accordance with the method of claim 11 further comprising the steps of:

creating at least one orifice in an orifice plate, said orifice extending from a first surface of said orifice plate to a second surface of said orifice plate and having a bore of a fourth dimension; and disposing said orifice plate on said barrier layer, whereby ink may be expelled by said ink ejector through said created orifice.

13. A method in accordance with the method of claim 12 further comprising the step of creating said bore fourth dimension greater than said first dimension.

14. A method in accordance with the method of claim 11 further comprising the step of disposing each island of said plurality of islands no closer to either of said walls of said ink feed channel than 9.75 $\mu$m.

15. A method of manufacture of a printhead which ejects ink from at least one firing chamber for an inkjet printer, comprising the steps of:

disposing a barrier layer having a thickness of a first dimension on a portion of a substrate;

exposing a predetermined portion of said barrier layer to electromagnetic radiation, said predetermined portion including walls of an ink feed channel which couples ink from a source of ink to the firing chamber, and a plurality of islands, each island of said plurality of islands spaced apart from an adjacent island of said plurality of islands by no more than a second dimension and disposed between said source of ink and said ink feed channel, said second dimension being less than said first dimension;

developing said barrier layer to remove portions of said barrier layer not exposed to electromagnetic radiation;

creating a least one orifice in an orifice plate, said orifice extending from a first surface of said orifice plate to a second surface of said orifice plate and having a bore of a third dimension, said third dimension being greater than said first dimension; and disposing said orifice plate on said barrier layer, whereby ink may be ejected from the firing chamber through said created orifice.

16. A method in accordance with the method of claim 15 wherein said step of exposing a predetermined portion of said barrier layer to electromagnetic radiation to include walls of an ink feed channel further comprises the step of spacing apart said walls one from the other by a fourth dimension, said fourth dimension being equal to or greater than said first dimension.

17. A method in accordance with the method of claim 15 further comprising the step of disposing each island of said plurality of islands no closer to either of said walls of said ink feed channel than 9.75 $\mu$m.

* * * * *